US009431781B2

(12) United States Patent
Kuang et al.

(10) Patent No.: US 9,431,781 B2
(45) Date of Patent: Aug. 30, 2016

(54) SIGNAL CONNECTOR FOR HIGH-SPEED TRANSMISSION

(71) Applicant: BizConn International Corp., Guangdong Province (CN)

(72) Inventors: Hong-Guang Kuang, Guangdong Province (CN); Jia-Mao Zheng, Guangdong Province (CN)

(73) Assignee: BizConn International Corp., Guangdong Province (CN)

( * ) Notice: Subject to any disclaimer, the term of this patent is extended or adjusted under 35 U.S.C. 154(b) by 0 days.

(21) Appl. No.: 14/736,235

(22) Filed: Jun. 10, 2015

(65) Prior Publication Data

US 2016/0036167 A1 Feb. 4, 2016

(30) Foreign Application Priority Data

Jul. 29, 2014 (CN) ..... 2014 2 0421215 U

(51) Int. Cl.
*H01R 13/648* (2006.01)
*H01R 24/60* (2011.01)
*H01R 13/6586* (2011.01)

(52) U.S. Cl.
CPC ..... *H01R 24/60* (2013.01); *H01R 13/6586* (2013.01)

(58) Field of Classification Search
CPC ..... H01R 13/658; H01R 12/724; H01R 13/65802; H01R 23/688; H01R 23/6873; H01R 33/7628; H01R 13/514; H01R 13/65807; H01R 23/005
USPC ..... 439/607.34, 607.05, 660, 79, 76.1
See application file for complete search history.

(56) References Cited

U.S. PATENT DOCUMENTS 5,161,169 A * 11/1992 Galano ..... G06F 1/18 361/679.31
5,188,536 A * 2/1993 Ganthier ..... H01R 12/714 439/406
5,190,480 A * 3/1993 Chau ..... H01R 12/721 439/567
6,149,468 A * 11/2000 Meng ..... H01R 12/82 439/637
6,210,230 B1 * 4/2001 Lai ..... H01R 9/0518 439/101
6,273,749 B1 * 8/2001 Yang ..... H01R 9/0515 439/497
6,551,121 B1 * 4/2003 Li ..... H01R 12/83 439/328
6,648,697 B2 * 11/2003 Yang ..... H01R 13/65807 439/701
6,716,057 B1 * 4/2004 Wu ..... H01R 13/6589 439/497

(Continued)

*Primary Examiner* — Abdullah Riyami
*Assistant Examiner* — Vladimir Imas
(74) *Attorney, Agent, or Firm* — CKC & Partners Co., Ltd.

(57) ABSTRACT

Provided is a signal connector including a plug insulator, a first terminal insulator, a second terminal insulator, and a first terminal group and a second terminal group. The first terminal insulator and the second terminal insulator are connected to the plug insulator. The front end and the rear end of the first terminal group extend beyond the first terminal insulator. The front end and the rear end of the second terminal group extend beyond the second terminal insulator. The middle portion of the first terminal group is embedded in the first terminal insulator. The middle portion of the second terminal group is embedded in the second terminal insulator. The first terminal group and the second terminal group each include a plurality of high frequency terminals. The width of the middle portion of each high frequency terminal is smaller than that of the front end of each high frequency terminal.

7 Claims, 4 Drawing Sheets

(56) References Cited

U.S. PATENT DOCUMENTS 6,935,896 B1 * 8/2005 Tsai ..... H01R 13/506 439/541.5
7,025,637 B1 * 4/2006 Lee ..... H01R 27/00 439/638
7,052,326 B2 * 5/2006 Yu ..... G06K 7/0034 439/631
7,118,411 B2 * 10/2006 Huang ..... H01R 31/065 439/502
7,300,315 B2 * 11/2007 Lai ..... H05K 1/18 439/637
7,530,844 B2 * 5/2009 Shen ..... H01R 13/5045 439/598
7,572,071 B1 * 8/2009 Wu ..... G02B 6/3817 385/101
7,641,518 B2 * 1/2010 Lee ..... H01R 13/6666 439/188
7,670,156 B2 * 3/2010 Chen ..... H01R 13/6485 439/108
7,722,406 B2 * 5/2010 Huang ..... H01R 31/06 439/638
7,748,999 B1 * 7/2010 Sun ..... H01R 12/716 439/607.36
7,758,374 B2 * 7/2010 Yu ..... H01R 4/027 439/493
8,141,242 B2 * 3/2012 Huang ..... H05K 3/242 174/254
8,303,358 B1 * 11/2012 Hung ..... H01R 12/777 439/521
8,400,177 B2 * 3/2013 Chiu ..... G01R 1/0416 324/760.01
8,475,216 B2 * 7/2013 Tung ..... H01R 13/506 439/607.4
8,562,378 B2 * 10/2013 Su ..... H01R 13/502 439/607.55
8,622,767 B2 * 1/2014 Nakazura ..... H01R 12/79 439/499
8,808,029 B2 * 8/2014 Castillo ..... H01R 13/6585 439/607.05
9,093,784 B2 * 7/2015 Zhang ..... H01R 13/6272
9,231,356 B1 * 1/2016 Ju ..... H01R 24/78
2012/0322306 A1 * 12/2012 Tai ..... H01R 13/6477 439/607.01

* cited by examiner

SIGNAL CONNECTOR FOR HIGH-SPEED TRANSMISSION

RELATED APPLICATIONS

This application claims priority to Chinese Patent Application Serial Number 201420421215.6, filed on Jul. 29, 2014. The entirety of the above-mentioned application is hereby incorporated by reference and made a part of this specification.

BACKGROUND

1. Field of Invention

The present invention is related to the field of electric connectors, and more particularly, to a signal connector for high-speed transmission.

2. Description of Related Art

With the development of technology, various electronic devices have been invented. The advent of these electronic devices has facilitated human daily life and work. Generally, each electronic device includes one or more data interfaces. When the various existing electronic devices are in operation, the data transmission or electrical signal transmission has to be performed via connectors. In addition, with the continuous evolvement of the wireless communication technology and the high-speed data transmission interface, the transmission of the electronic divides have entered a generation of high-speed transmission of 6 Gb/s or 12 Gb/s or more, so as to satisfy the requirements for numerous rising applications such as vehicles, computers and peripherals, handheld electronic devices, and medical devices, etc. However, in the existing high-speed data transmission connectors, signals from different terminals inevitably interfere with one another, leading to an unstable signal transmission and affecting the correctness of data transmission. Therefore, the date transmission speed of a high-speed connector cannot be further increased, and the transmission efficiency is low.

SUMMARY

To solve the aforementioned issues, the present invention provides a signal connector for high-speed transmission in which signals from different terminals would not interfere with one another, and thus the signal transmission of the signal connector can be stable.

The technical solution of the present invention is to provide a signal connector for high-speed transmission, including a plug insulator, a first terminal insulator, a second terminal insulator, and a first germinal group and a second terminal group each composed of a plurality of terminals arranged in parallel. The first terminal insulator and the second terminal insulator are connected together. The front end of the first terminal insulator and the front end of the second terminal insulator are connected to the rear end of the plug insulator. The front end and the rear end of the first terminal group extend beyond the first terminal insulator. The front end and the rear end of the second terminal group extend beyond the second terminal insulator. The middle portion of the first terminal group is embedded in the first terminal insulator. The middle portion of the second terminal group is embedded in the second terminal insulator. The front end of the first terminal group and the front end of the second terminal group are respectively disposed inside of the plug insulator. The first terminal group and the second terminal group each include a plurality of high frequency terminals. The width of the middle portion of each high frequency terminal is smaller than the width of the front end of each high frequency terminal.

As a further improvement to the present invention, a metal shielding sheet is further included. The metal shielding sheet is disposed between the first terminal insulator and the second terminal insulator.

As a further improvement to the present invention, the metal shielding sheet includes a metal shielding sheet body. A first shielding protrusion extends from each side of the metal shielding sheet body in an extending direction toward the plug insulator, and a second shielding protrusion extends from each side of the metal shielding sheet body in an extending direction opposite to the extending direction of the first shielding protrusion. The front end of each first shielding protrusion is disposed in a shielding slot of the plug insulator. Each second shielding protrusion extends beyond the first terminal insulator and the second terminal insulator.

As a further improvement to the present invention, a front metal case is further included. The plug insulator, the front end of the first terminal insulator, and the front end of the second terminal insulator are disposed in the front metal case. Each first shielding protrusion and the front metal case are electrically connected.

As a further improvement to the present invention, a PCB board is further included. An end of the PCB board is connected to the rear end of the first terminal insulator and the rear end of second terminal insulator. A rear end of each terminal in the first terminal group and the second terminal group is electrically connected to a gold finger on the PCB board. Each second shielding protrusion is electrically connected to a grounding gold finger of the PCB board.

As a further improvement to the present invention, a rear metal case is further included. The PCB board, the rear end of the first terminal insulator, and the rear end of the second terminal insulator are disposed in the rear metal case. The front metal case and the rear metal case are connected.

As a further improvement to the present invention, a first engaging protrusion and a second engaging protrusion are formed respectively on the rear end of the first terminal insulator and the rear end of the second terminal insulator. An end of the PCB board is fixed between the first engaging protrusion and the second engaging protrusion.

As a further improvement to the present invention, a first column and a second latching hole are formed on the first terminal insulator, and a second column and a first latching hole are formed on the second terminal insulator. The first terminal insulator and the second terminal insulator are combined together by engaging the first column into the first latching hole and engaging the second column into the second latching hole.

As a further improvement to the present invention, a plurality of through holes are formed on the metal shielding sheet body. The first column and the second column are respectively inserted through each through hole, thereby fixing the metal shielding sheet between the first terminal insulator and the second terminal insulator.

As a further improvement to the present invention, a first metal elastic sheet and a second metal elastic sheet are further included. The first metal elastic sheet and the second metal elastic sheet are disposed at the front ends of the two opposing sidewalls of the plug insulator. A first hollow portion for the elastic sheet and a second hollow portion for the elastic sheet are formed respectively at the front ends of the two opposing sidewalls of the plug insulator. The elastic sheets of the first metal elastic sheet and the second metal elastic sheet are respectively inserted through the first hollow portion for the elastic sheet and the second hollow portion for the elastic sheet and disposed inside of the plug insulator.

In the present invention, a metal shielding sheet and a plurality of high frequency terminals are adopted. The width of the middle portion of each high frequency terminal is smaller than the width of the front end of each high frequency terminal, so that the data transmission speed of each high frequency terminal is enhanced. The metal shielding sheet is disposed between the first terminal insulator and the second terminal insulator, so that the signals transmitted by the first terminal group and the second terminal group would not interfere with one another. Accordingly the signal transmission can be more stable. In addition, the front metal case and the rear metal case are connected, and the front metal case is electrically connected to the grounding gold finger on the PCB board via each first shielding protrusion and each second shielding protrusion of the metal shielding sheet. As a result, the grounding effect of the connector is good. The connector has advantages in that it has a fast transmission speed, provides stable signal transmission and good grounding effect, and lowers energy consumption of the power terminals, etc.

BRIEF DESCRIPTION OF THE DRAWINGS

The invention can be more fully understood by reading the following detailed description of the embodiment, with reference made to the accompanying drawings as follows.

DETAILED DESCRIPTION

In the description of the present invention, it should be noticed, direction or position relation indicated by terms such as "at the center of," "below," "in front of," "behind," "at the left of," "at the right of" are orientation or position relation in connection with the figures. These terms are used to simplify the description of the present invention, and are not intended to indicate or suggest a specific configuration or orientation for operation for the device or element being described. Therefore, these terms cannot be construed as limitations to the present invention. In addition, terms such as "first" and "second" are used for descriptive purpose and shall not be construed as indicating or suggesting an element is more significant than another.

In the description of the present invention, it should be noticed, unless otherwise specified, terms such as "mounted," "joined," and "connected" should be construed in their broad sense. For example, "connected" includes "fixedly connected," "detachably connected," or "integrally connected"; it also includes "mechanically connected" or "electrically connected", it further includes "directly connected," "connected via an intermediate element," or implies the inner connection of two elements. The meaning of these terms in the present invention can be understood by the persons having ordinary skills in the art in light of the specific context. In addition, unless otherwise specified, in the description of the present invention, "a plurality of," or "several" means two or more than two.

Figure 1:
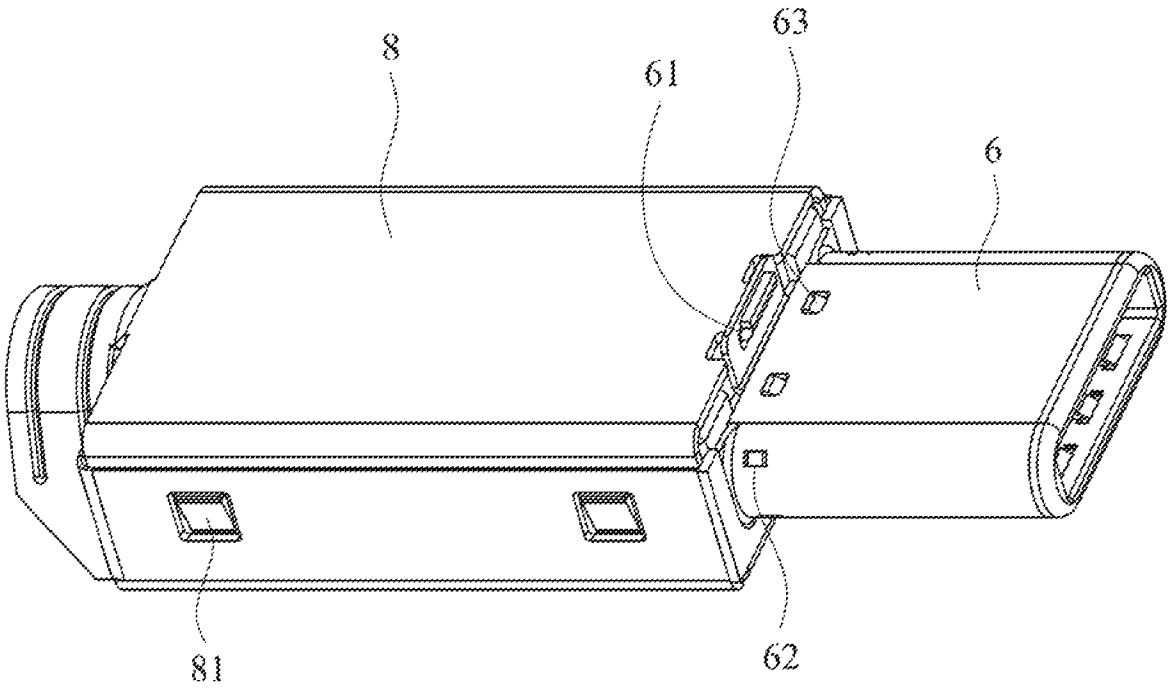
FIG. 1 is a schematic three-dimensional structural diagram of a signal connector of the present invention.
Figure 2:
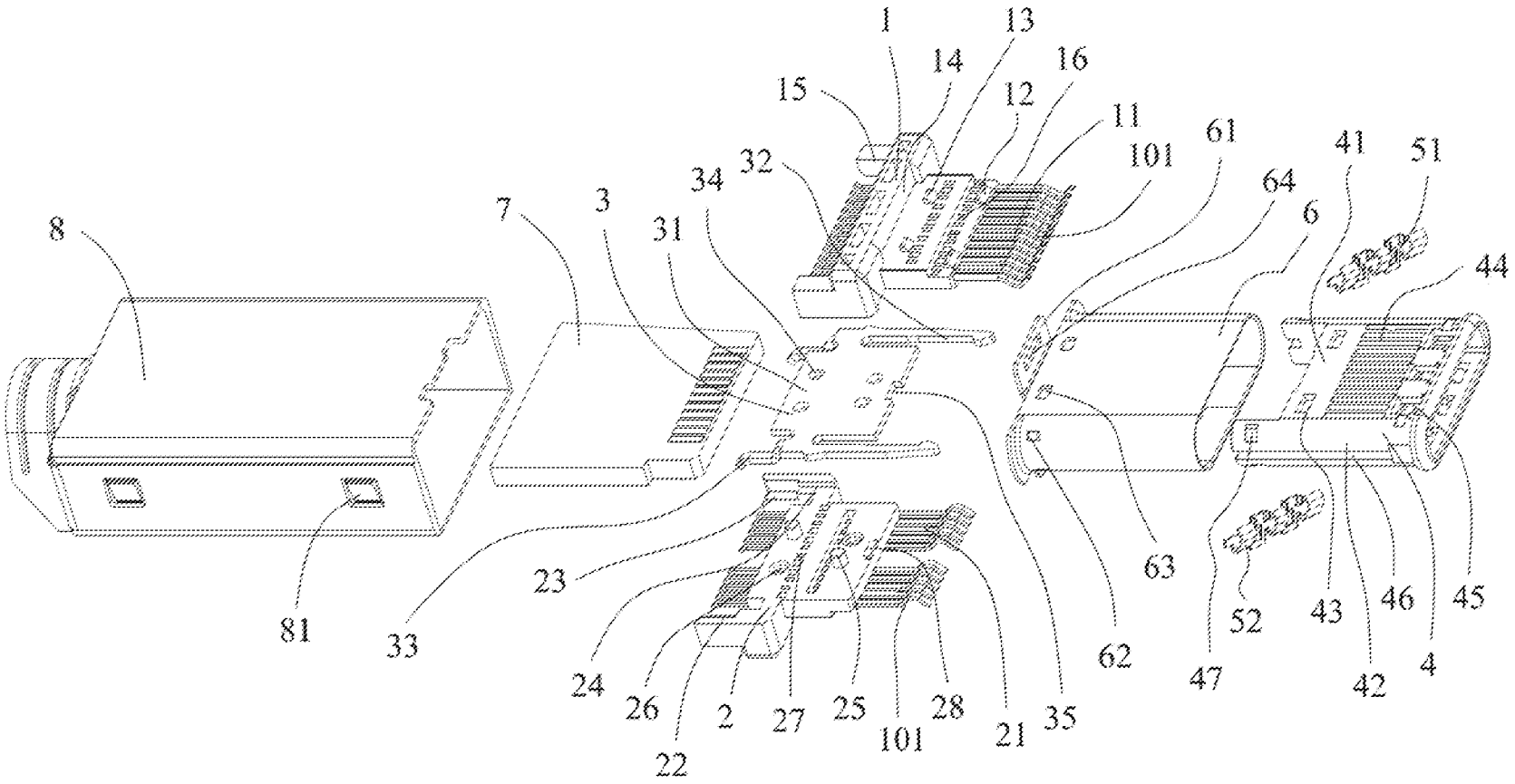
FIG. 2 is a schematic exploded view of the signal connector shown in FIG. 1.
Figure 3:
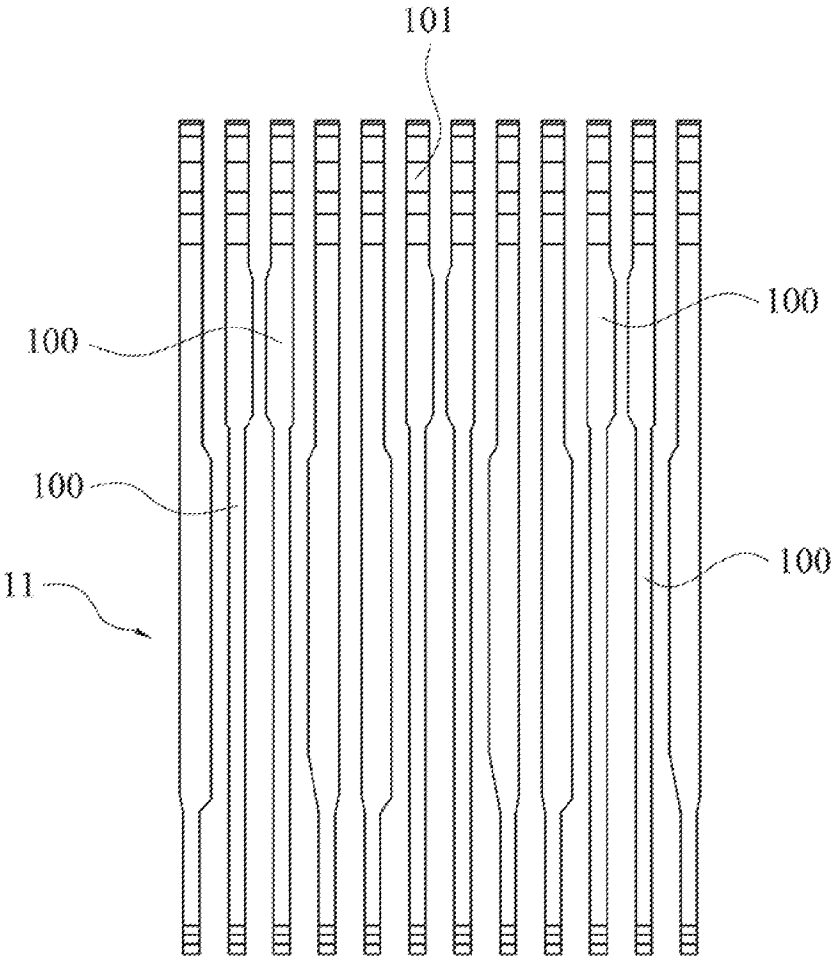
FIG. 3 is a schematic planar structural view of a first terminal group shown in FIG. 2.
Figure 4:
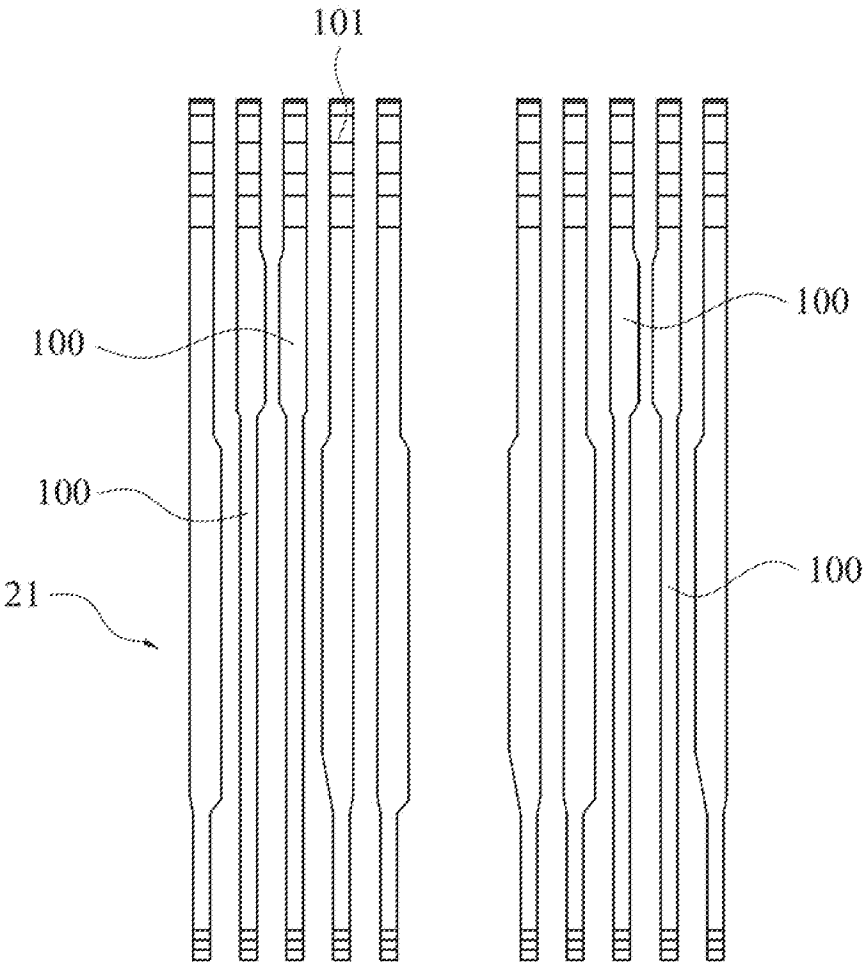
FIG. 4 is the a schematic planar structural view of a second terminal group shown in FIG. 2.

Please refer to FIG. 1 to FIG. 4. FIG. 1 to FIG. 4 disclose a signal connector for high-speed transmission including a plug insulator 4, a first terminal insulator 1, a second terminal insulator 2, a metal shielding sheet 3, a front metal case 6, a rear metal case 8, a PCB board 7, a first metal elastic sheet 51, a second metal elastic sheet 52, and a first terminal group 11 and a second terminal group 21 each composed of a plurality of terminals. The first terminal insulator 1 and the second terminal insulator 2 are connected together; that is, the first terminal insulator 1 and the second terminal insulator 2 are connected, in which the components of the upper first terminal insulator 1 correspond to the components of lower the second terminal insulator 2. The front end of the first terminal insulator 1 and the front end of the second terminal insulator 2 are connected to the rear end of the plug insulator 4. The front end and the rear end of the first terminal group 11 extend beyond the first terminal insulator 1. The front end and the rear end of the second terminal group 21 extend beyond the second terminal insulator 2. The middle portion of the first terminal group 11 is embedded in the first terminal insulator 1. The middle portion of the second terminal group 21 is embedded in the second terminal insulator 2. The front end of the first terminal group 11 and the front end of the second terminal group 21 are disposed inside of the plug insulator 4. The first terminal group 11 and the second terminal group 21 each include a plurality of high frequency terminals 100. The width of the middle portion of a high frequency terminal 100 is smaller than the width of the front end of the high frequency terminal. An elastic contact portion 101 is formed on the front end of each terminal in the first terminal group 11 and the second terminal group 21. This design enhances the data transmission speed of each high frequency terminal 100, and in addition, the interference between terminals is reduced, leading to a stable signal transmission.

In this embodiment, a first fixing protrusion 12, a third fixing protrusion 13, and a first lug well 14 are formed on the outer wall of the front end of the first terminal insulator 1. A first engaging protrusion 15 is formed on the rear end of the first terminal insulator 1. A first PCB board slot (not shown in the figures) is formed on the first engaging protrusion 15. A first metal sheet slot (not shown in the figures), a first column (not shown in the figures), and a second latching hole (not shown in the figures) are formed on a surface of the first terminal insulator 1 adjacent to the second terminal insulator 2. A first terminal hollow portion 16 is formed on the front end of the first terminal insulator 1, and the first terminal hollow portion 16 is positioned corresponding to the first terminal group 11.

In this embodiment, a second fixing protrusion (not shown in the figures), a fourth fixing protrusion (not shown in the figures), and a second lug well (not shown in the figures) are formed on the outer wall of the front end of the second terminal insulator 2. A second engaging protrusion 22 is formed on the rear end of the second terminal insulator 2. A second PCB board slot 23 is formed on the second engaging protrusion 22. A second metal sheet slot 24, a second column 25, and a first latching hole 26 are formed on a surface of the second terminal insulator 2 adjacent to the first terminal insulator 1. A second terminal hollow portion 27 is formed on the front end of the second terminal insulator 2, and the second terminal hollow portion 27 is positioned corresponding to the second terminal group 21. By engaging the first column into the first latching hole 26 and engaging the second column 25 into the second latching hole, the first terminal insulator 1 and the second terminal insulator 2 are engaged together.

In this embodiment, the plug insulator 4 includes a first sidewall 41, a second sidewall (not shown in the figures), a third sidewall 42, and a fourth sidewall (not shown in the figures). The first sidewall 41 and the second sidewall are arranged opposingly. The third sidewall 42 and the fourth sidewall are arranged opposingly. A first fixing hole 43, a plurality of first hollow portions 44, and a first hollow portion for the elastic sheet 45 are respectively formed on the rear end, on the middle portion, and on the front end of the first sidewall 41. A second fixing hole (not shown in the figures), a plurality of second hollow portion (not shown in the figures), and a second hollow portion for the elastic sheet (not shown in the figures) are respectively formed on the rear end, on the middle portion, and on the front end of the second sidewall. A shielding slot 46 is formed on each of the third sidewall 42 and the fourth sidewall. When the front end of the first terminal insulator 1 and the front end of the second terminal insulator 2 are respectively disposed inside of the rear end of the plug insulator 4, each first fixing protrusion 12 of the first terminal insulator 1 is engaged with a first fixing hole 43, and each second fixing protrusion of the second terminal insulator 2 is engaged with a second fixing hole. The front end of the first terminal group 11 and the front end of the second terminal group 21 are respectively leaned against the two opposing inner sidewalls (i.e. the inner wall of the first sidewall 41 and the inner wall of the second sidewall) of the plug insulator 4. An elastic contact portion 101 of the front end of each terminal in the first terminal group 11 and the second terminal group 21 protrudes toward the interior of the plug insulator 4. Each first hollow portion 44 is disposed between two adjacent terminals in the first terminal group 11. Each second hollow portion is disposed between two adjacent terminals in the second terminal group 21.

In this embodiment, the metal shielding sheet 3 is disposed between the first terminal insulator 1 and the second terminal insulator 2, and engaged in the first metal sheet slot and the second metal sheet slot 24. The metal shielding sheet 3 includes a metal shielding sheet body 31. A first shielding protrusion 32 extends from each side of the metal shielding sheet body 31 in an extending direction toward the plug insulator 4, and a second shielding protrusion 33 extends from each side of the metal shielding sheet body 31 in an extending direction opposite to the extending direction of the first shielding protrusion 32. The front end of each first shielding protrusion 32 is disposed in a shielding slot 46. Each second shielding protrusion 33 extends beyond the first terminal insulator 1 and the second terminal insulator 2. Through holes 34 and a limiting recess 35 are formed on the metal shielding sheet body 31. The first column and the second column 25 are respectively inserted through each through hole 34, so as to fix the metal shielding sheet body 31 between the first terminal insulator 1 and the second terminal insulator 2. The limiting recess 35 matches with a limiting block 28 formed on the first terminal insulator 1 or on the second terminal insulator 2.

In this embodiment, the front metal case 6 is included. The plug insulator 4, the front end of the first terminal insulator 1 and the front end of the second terminal insulator 2 are disposed in the front metal case 6. Each first shielding protrusion 32 is electrically connected to the front metal case 6. A plurality of lugs 61, an inward protrusion 62, a third fixing hole 63, and a fourth fixing hole (not shown in the figures) are formed on the front metal case 6. The lugs 61 are disposed respectively in the first lug well 14 and the second lug well. The inward protrusion 62 matches with a recess 47 disposed on the outer wall of the plug insulator 4. The third fixing hole 63 and the fourth fixing hole match respectively with the third fixing protrusion 13 and the fourth fixing protrusion. The front metal case 6 is fixedly connected to the outer wall of the plug insulator 4, the outer wall of the first terminal insulator 1, and the outer wall of the second terminal insulator 2.

In this embodiment, an end of the PCB board 7 is connected to the rear end of the first terminal insulator 1 and the rear end of the second terminal insulator 2. That is, the end of the PCB board 7 is engaged in the first PCB board slot and the second PCB board slot 23. The first engaging protrusion 15 and the second engaging protrusion 22 are configured to fix the PCB board 7. The rear end of each terminal in the first terminal group 11 and the second terminal group 21 is electrically connected to a gold finger on the PCB board 7. Each second shielding protrusion 33 electrically connected to a grounding gold finger on the PCB board 7.

In this embodiment, the rear metal case 8 is included. The PCB board 7, the rear end of the first terminal insulator 1 and the rear end of the second terminal insulator 2 are disposed in the rear metal case 8. The front end of the rear metal case 8 matches with a lug hole 64 on the lug 61 so as to connect the front metal case 6 and the rear metal case 8. An inward protruding engagement part 81 is formed on the rear metal case 8. The inward protruding engagement part 81 matches with a recessed engagement part disposed on each of the first terminal insulator 1 and the second terminal insulator 2 so as to fixedly connect the rear metal case 8 to the first terminal insulator 1 and the second terminal insulator 2.

In this embodiment, a first metal elastic sheet 51 and a second metal elastic sheet 52 are disposed at the front ends of the two opposing sidewalls the first sidewall 41 and the second sidewall) of the plug insulator 4. The elastic sheets of the first metal elastic sheet 51 and the second metal elastic sheet 52 are respectively inserted through the first hollow portion for the elastic sheet 45 and the second hollow portion for the elastic sheet and disposed inside of the plug insulator 4. The first metal elastic sheet 51 and the second metal elastic sheet 52 are configured to reinforce the structural strength of the connector and to facilitate the combination of the connector.

In the present invention, the metal shielding sheet 3 reduces the signal interference between the first terminal group 11 and the second terminal group 21, resulting in a stable signal transmission. In addition, the front metal case 6 and the rear metal case 8 are connected. The front metal case 6 is electrically connected to the grounding gold finger on the PCB board 7 via each first shielding protrusion 32 and each second shielding protrusion 33, and thus the grounding effect of the connector is good. The first terminal hollow portion 16 and the first hollow portion 44 not only reduce the signal interference between the terminals in the first terminal group 11 but also provide a heat dissipation effect, and therefore the signal transmission speed is enhanced. The second terminal hollow portion 27 and the second hollow portion not only reduce the signal interference between the terminals in the second terminal group 21 but also provide a heat dissipation effect, and therefore the signal transmission speed is enhanced. The present invention has advantages in that the connector has a fast transmission speed, provides stable signal transmission and good grounding effect, and lowers energy consumption of the power terminals, etc.

What is claimed is:

1. A signal connector for high-speed transmission, comprising:

a plug insulator;

a first terminal insulator and a second terminal insulator;

a first terminal group and a second terminal group each composed of a plurality of terminals arranged in parallel, wherein the first terminal insulator and the second terminal insulator are connected together; a front end of the first terminal insulator and a front end of the second terminal insulator are connected to a rear end of the plug insulator; the front end and a rear end of the first terminal group extend beyond the first terminal insulator; the front end and a rear end of the second terminal group extend beyond the second terminal insulator; a middle portion of the first terminal group is embedded in the first terminal insulator; a middle portion of the second terminal group is embedded in the second terminal insulator; the front end of the first terminal group and the front end of the second terminal group are respectively disposed inside of the plug insulator;

the first terminal group and the second terminal group comprise a plurality of high frequency terminals, and a width of a middle portion of each of the high frequency terminals is smaller than a width of a front end of each of the high frequency terminals;

a metal shielding sheet, wherein the metal shielding sheet is disposed between the first terminal insulator and the second terminal insulator, the metal shielding sheet comprising:

a metal shielding sheet body;

a first shielding protrusion extending from each side of the metal shielding sheet body in an extending direction toward the plug insulator; and a second shielding protrusion extending from each side of the metal shielding sheet body in an extending direction opposite to the extending direction of the first shielding protrusion, wherein a front end of the first shielding protrusion is disposed in a shielding slot of the plug insulator, and the second shielding protrusion extends beyond the first terminal insulator and the second terminal insulator;

a front metal case, wherein the plug insulator, the front end of the first terminal insulator, and the front end of the second terminal insulator are disposed in the front metal case, and the first shielding protrusion is electrically connected to the front metal case; and a PCB board, wherein an end of the PCB board is connected to the rear end of the first terminal insulator and the rear end of the second terminal insulator; a rear end of a terminal in the first terminal group and the second terminal group is electrically connected to a gold finger on the PCB board; and the second shielding protrusion is electrically connected to a grounding gold finger on the PCB board.

2. The signal connector of claim 1, further comprising a rear metal case, wherein the PCB board, the rear end of the first terminal insulator, and the rear end of the second terminal insulator are disposed in the rear metal case, and the front metal case and the rear metal case are connected.

3. The signal connector of claim 1, further comprising:

a first engaging protrusion formed on the rear end of the first terminal insulator; and a second engaging protrusion formed on the rear end of the second terminal insulator, wherein the end of the PCB board is fixed between the first engaging protrusion and the second engaging protrusion.

4. The signal connector of claim 1, further comprising:

a first column and a second latching hole formed on the first terminal insulator; and a second column and a first latching hole formed on the second terminal insulator, wherein the first terminal insulator and the second terminal insulator are combined together by engaging the first column into the first latching hole and engaging the second column into the second latching hole.

5. The signal connector of claim 4, further comprising a plurality of through holes formed on the metal shielding sheet body, wherein the first column and the second column are respectively inserted through each of the through holes, thereby fixing the metal shielding sheet between the first terminal insulator and the second terminal insulator.

6. The signal connector of claim 1, further comprising:

a first metal elastic sheet and a second metal elastic sheet disposed at front ends of two opposing sidewalls of the plug insulator; and a first hollow portion for elastic sheet and a second hollow portion for elastic sheet formed respectively at the front ends of the two opposing sidewalls of the plug insulator, wherein the first metal elastic sheet and the second metal elastic sheet are respectively inserted through the first hollow portion for elastic sheet and the second hollow portion for elastic sheet and are disposed inside of the plug insulator.

7. The signal connector of claim 1, further comprising:

a first metal elastic sheet and a second metal elastic sheet disposed at a front end of two opposing sidewalls of the plug insulator; and a first hollow portion for elastic sheet and a second hollow portion for elastic sheet formed respectively at the front end of the two opposing sidewalls of the plug insulator, wherein the first metal elastic sheet and the second metal elastic sheet are respectively inserted through the first hollow portion for elastic sheet and the second hollow portion for elastic sheet and disposed inside of the plug insulator.

* * * * *